US010676832B2

(12) United States Patent
Mitsushima et al.

(10) Patent No.: US 10,676,832 B2
(45) Date of Patent: Jun. 9, 2020

(54) METHOD FOR PRODUCING ANODE FOR ALKALINE WATER ELECTROLYSIS, AND ANODE FOR ALKALINE WATER ELECTROLYSIS

(71) Applicants: DE NORA PERMELEC LTD, Fujisawa-shi, Kanagawa (JP); NATIONAL UNIVERSITY CORPORATION YOKOHAMA NATIONAL UNIVERSITY, Yokohama-shi, Kanagawa (JP); KAWASAKI JUKOGYO KABUSHIKI KAISHA, Kobe-shi, Hyogo (JP)

(72) Inventors: Shigenori Mitsushima, Yokohama (JP); Sho Fujita, Yokohama (JP); Ikuo Nagashima, Kobe (JP); Yoshinori Nishiki, Fujisawa (JP); Akiyoshi Manabe, Fujisawa (JP); Akihiro Kato, Fujisawa (JP)

(73) Assignees: DE NORA PERMELEC LTD, Fujisawa-shi, Kanagawa (JP); NATIONAL UNIVERSITY CORPORATION YOKOHAMA NATIONAL UNIVERSITY, Yokohama-shi, Kanagawa (JP); KAWASAKI JUKOGYO KABUSHIKI KAISHA, Kobe-shi, Hyogo (JP)

( * ) Notice: Subject to any disclaimer, the term of this patent is extended or adjusted under 35 U.S.C. 154(b) by 0 days.

(21) Appl. No.: 16/331,049

(22) PCT Filed: Sep. 11, 2017

(86) PCT No.: PCT/JP2017/032638
§ 371 (c)(1),
(2) Date: Mar. 6, 2019

(87) PCT Pub. No.: WO2018/047961
PCT Pub. Date: Mar. 15, 2018

(65) Prior Publication Data

US 2019/0226102 A1 Jul. 25, 2019

(30) Foreign Application Priority Data

Sep. 9, 2016 (JP) ..... 2016-176689

(51) Int. Cl.
*C25B 11/04* (2006.01)
*C25B 1/06* (2006.01)
(Continued)

(52) U.S. Cl.
CPC ..... *C25B 11/0405* (2013.01); *C25B 1/06* (2013.01); *C25B 9/00* (2013.01); *C25B 11/035* (2013.01);
(Continued)

(58) Field of Classification Search
CPC ..... C25B 11/0405; C25B 11/0489; C25B 11/035; C25B 11/0415; C25B 1/06;
(Continued)

(56) References Cited

U.S. PATENT DOCUMENTS 2,716,670 A 8/1955 Bacon
2,914,596 A 11/1959 Gorin et al.
(Continued)

FOREIGN PATENT DOCUMENTS

CA 2928790 5/2015
CN 105683418 6/2016
(Continued)

OTHER PUBLICATIONS

International Search Report, issued in the corresponding PCT application No. PCT/JP2017/032638, dated Oct. 10, 2017, 5 pages.
(Continued)

*Primary Examiner* — Louis J Rufo
(74) *Attorney, Agent, or Firm* — Hamre, Schumann, Mueller & Larson, P.C.

(57) ABSTRACT

Provided is a method capable of producing, in a simple and low-cost manner, an electrolysis electrode which can be used in alkaline water electrolysis and has superior durability against output variation. The method for producing an anode for alkaline water electrolysis includes: a step of
(Continued)

dissolving lithium nitrate and a nickel carboxylate in water to prepare an aqueous solution containing lithium ions and nickel ions, a step of applying the aqueous solution to the surface of a conductive substrate having at least the surface composed of nickel or a nickel-based alloy, and a step of subjecting the conductive substrate to which the aqueous solution has been applied to a heat treatment at a temperature within a range from at least 450° C. to not more than 600° C., thereby forming a catalyst layer composed of a lithium-containing nickel oxide on the conductive substrate.

10 Claims, 9 Drawing Sheets

(51) Int. Cl.
*C25B 9/00* (2006.01)
*C25B 11/03* (2006.01)

(52) U.S. Cl.
CPC ..... *C25B 11/0415* (2013.01); *C25B 11/0489* (2013.01)

(58) Field of Classification Search
CPC ..... C25B 11/0478; C25B 11/041; C25B 1/04; C23C 18/1216
See application file for complete search history.

(56) References Cited

U.S. PATENT DOCUMENTS 2,928,783 A 3/1960 Bacon
3,226,264 A 12/1965 Joseph et al.
5,817,436 A * 10/1998 Nishijima ..... H01M 4/525 429/223
6,015,637 A * 1/2000 Mitate ..... H01M 4/525 423/594.4
10,446,844 B2 * 10/2019 Wu ..... H01M 4/505
2016/0237578 A1 8/2016 Ichikawa

FOREIGN PATENT DOCUMENTS

EP 3064614 9/2016
GB 864457 4/1961
JP 2015-086420 5/2015
JP 2015086420 A * 5/2015
WO 2015/064644 5/2015

OTHER PUBLICATIONS

Lu et al., "Electrochemical-Ellipsometric Studies of Oxide Film Formed on Nickel during Oxygen Evolution", J. Electrochem. Soc., vol. 125, No. 9, pp. 1416-1422, Sep. 1978.
Bowen et al., "Developments in Advanced Alkaline Water Electrolysis", Int. J. Hydrogen Energy, vol. 9, No. 1/2, pp. 59-66, 1984.
Mitsushima et al., "Present technologies and subjects of water electrolysis", Hydrogen Energy Systems, vol. 36, No. 1, pp. 11-16, 2011.
Singh et al., "Electrocatalytic activity of metal-substituted Fe3O4 obtained at low temperature for O2 evolution", International Journal of Hydrogen Energy, vol. 24, pp. 433-439, 1999.
Juybari et al., "Nickel-lithium oxide alloy transparent conducting films deposited by spray pyrolysis technique", Journal of Alloys and Compounds, vol. 509, pp. 2770-2775, 2011.
Chinese Office Action, issued in the corresponding Chinese patent application No. 201780055096.3, dated Jul. 15, 2019, 5 pages.
Canadian Office Action, issued in the corresponding Canadian patent application No. 3,036,352, dated Apr. 26, 2019, 3 pages.
Second Canadian Office Action, issued in the corresponding Canadian patent application No. 3,036,352, dated Sep. 16, 2019, 4 pages.
Extended European Search Report, issued in the corresponding European patent application No. 17848899.5, dated Apr. 22, 2020, 7 pages.

* cited by examiner

[FIG. 1]
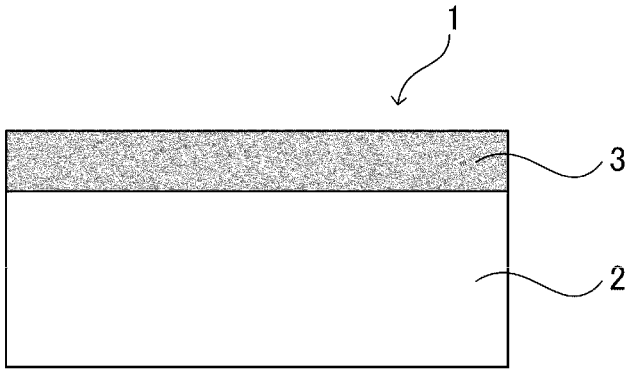
[FIG. 2]
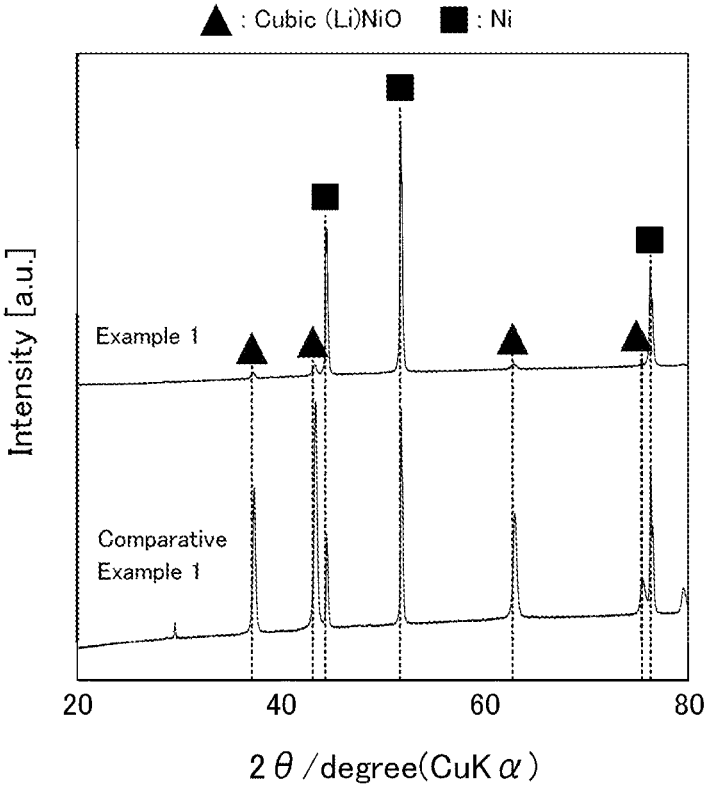

[FIG. 3(a)]
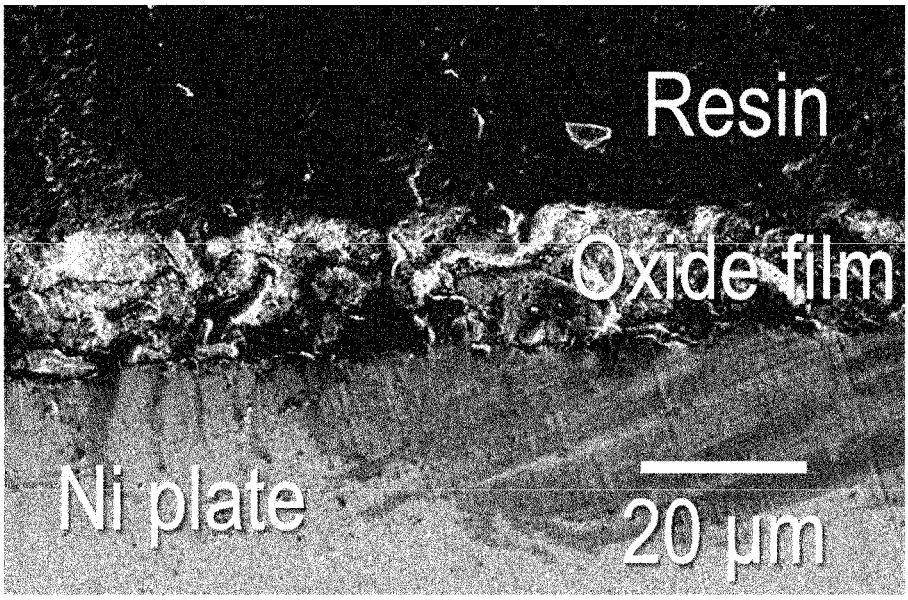
[FIG. 3(b)]
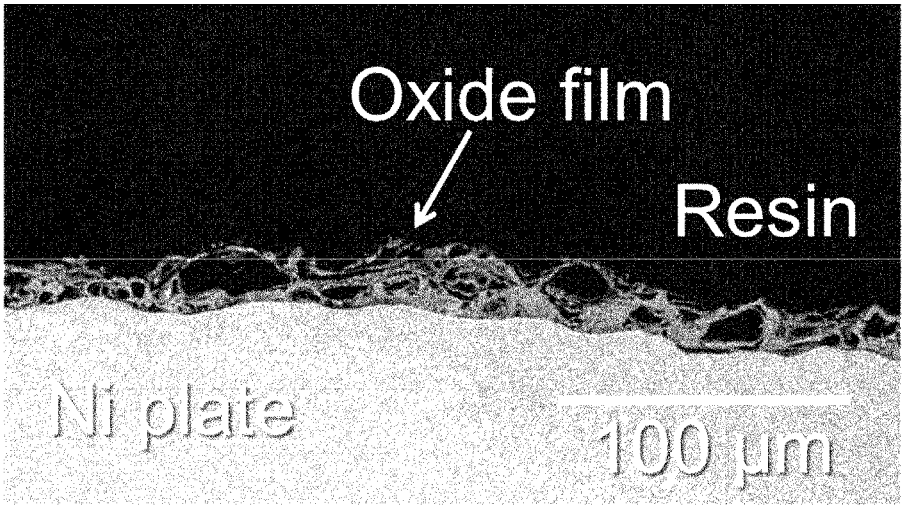

[FIG. 4]
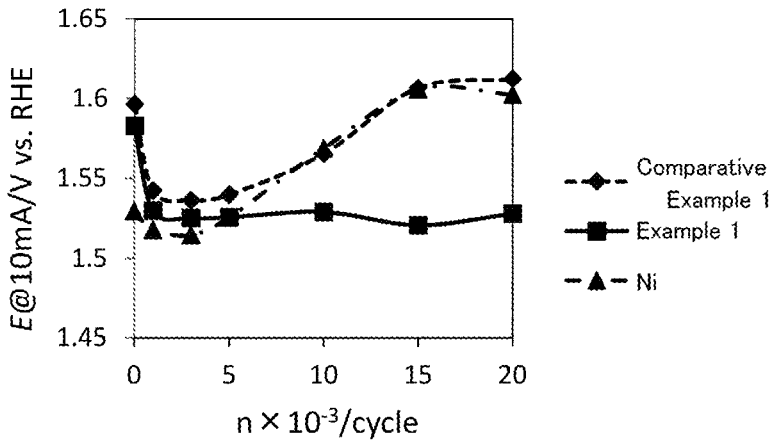
[FIG. 5]
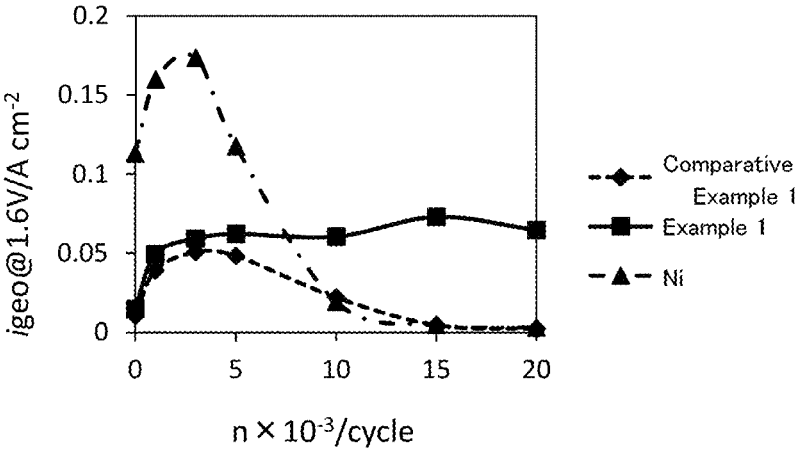
[FIG. 6]
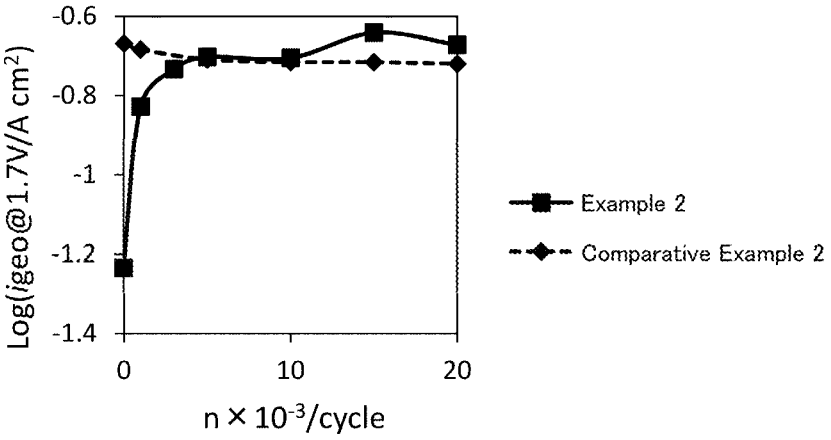

[FIG.7]
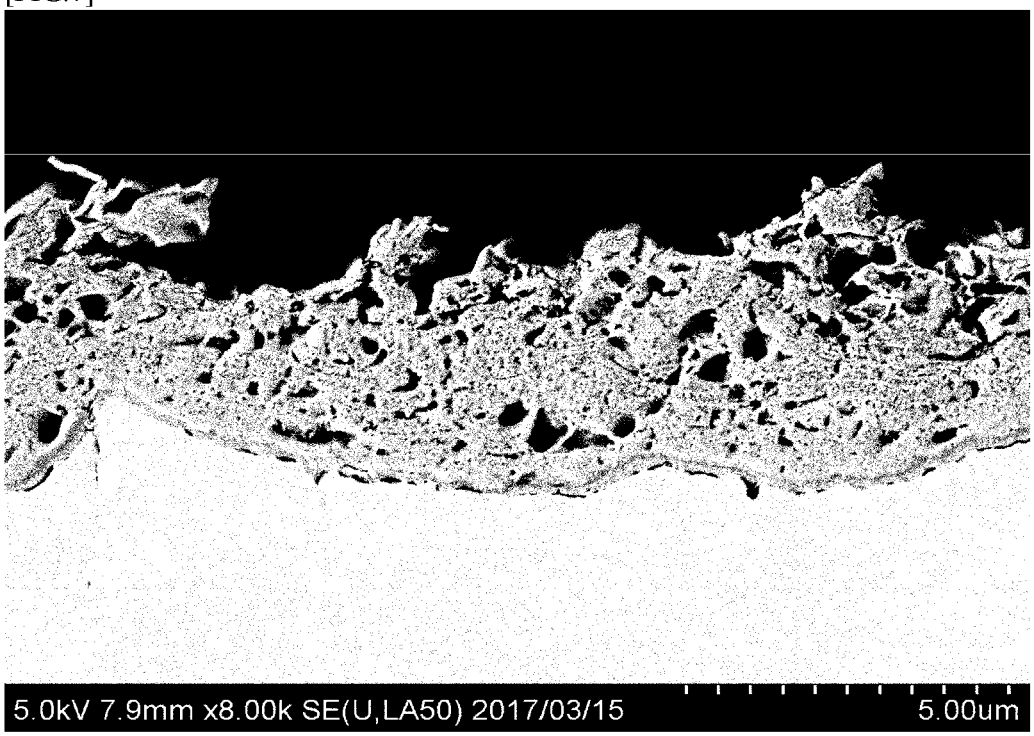
[FIG.8]
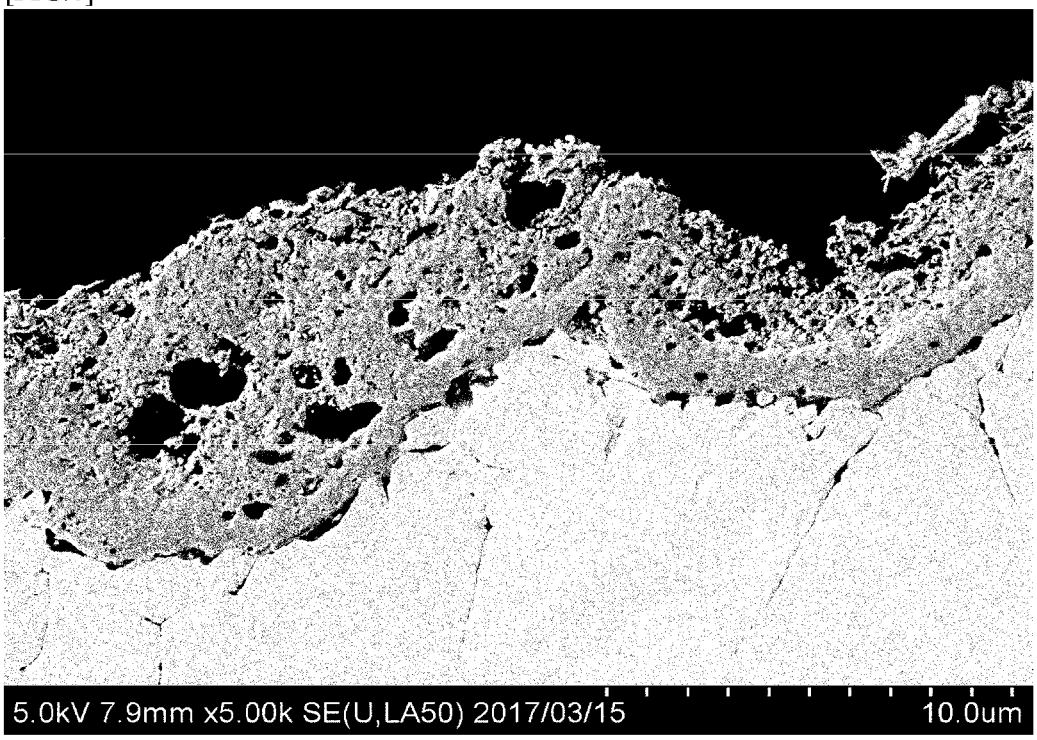

[FIG.9]
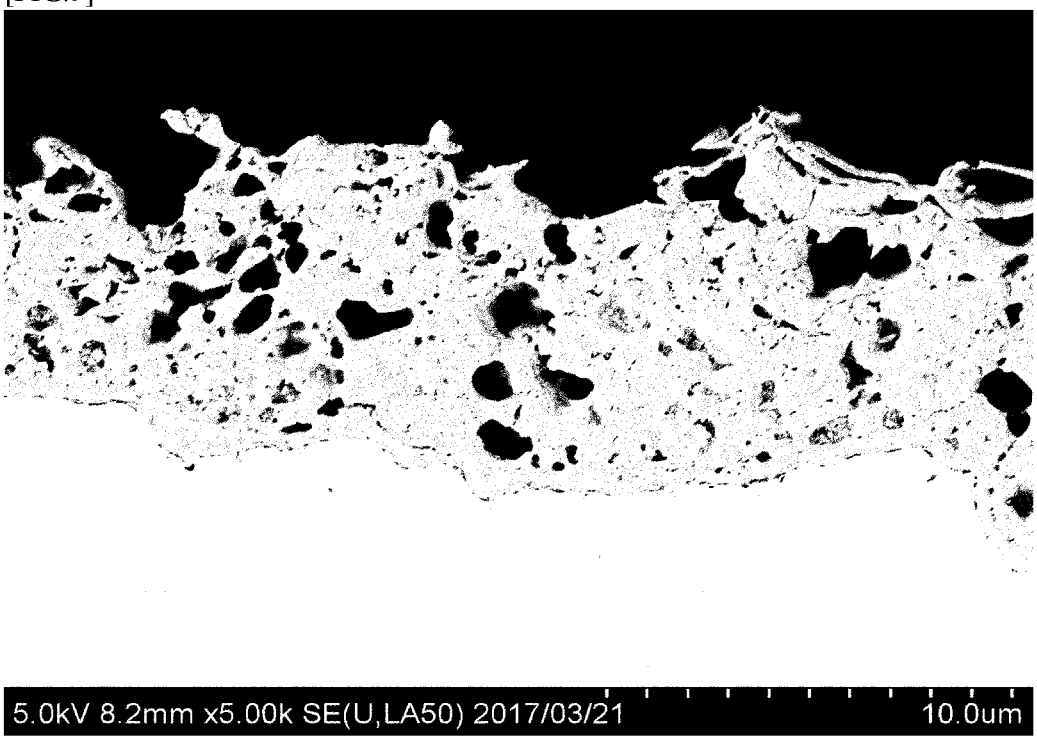
[FIG.10]
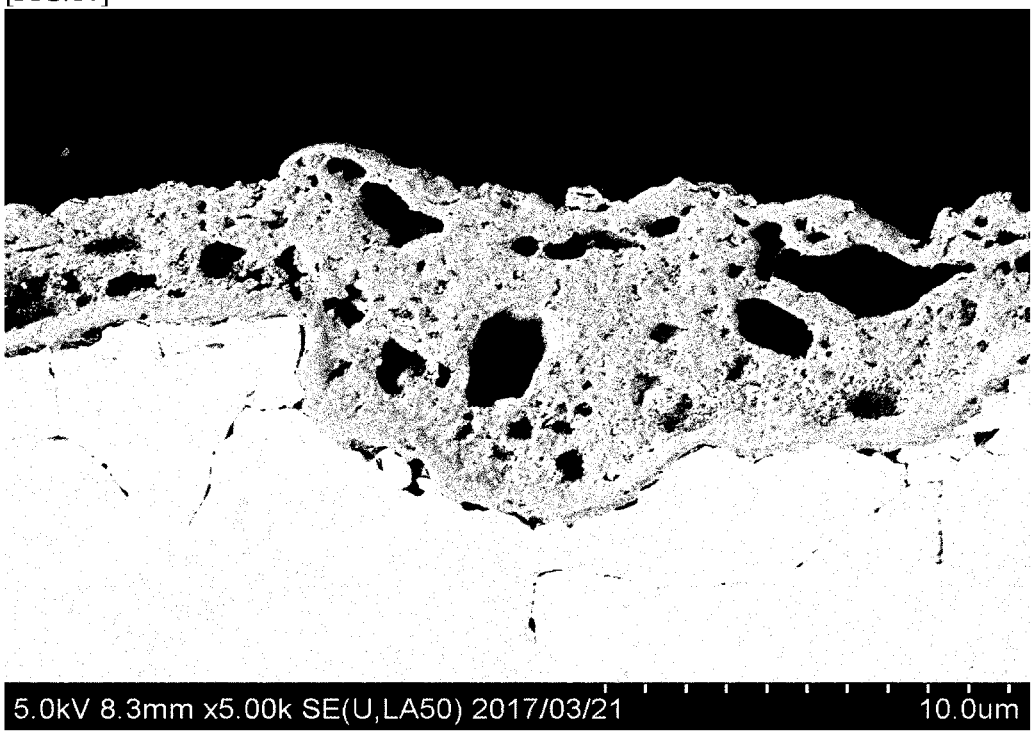

[FIG.11]
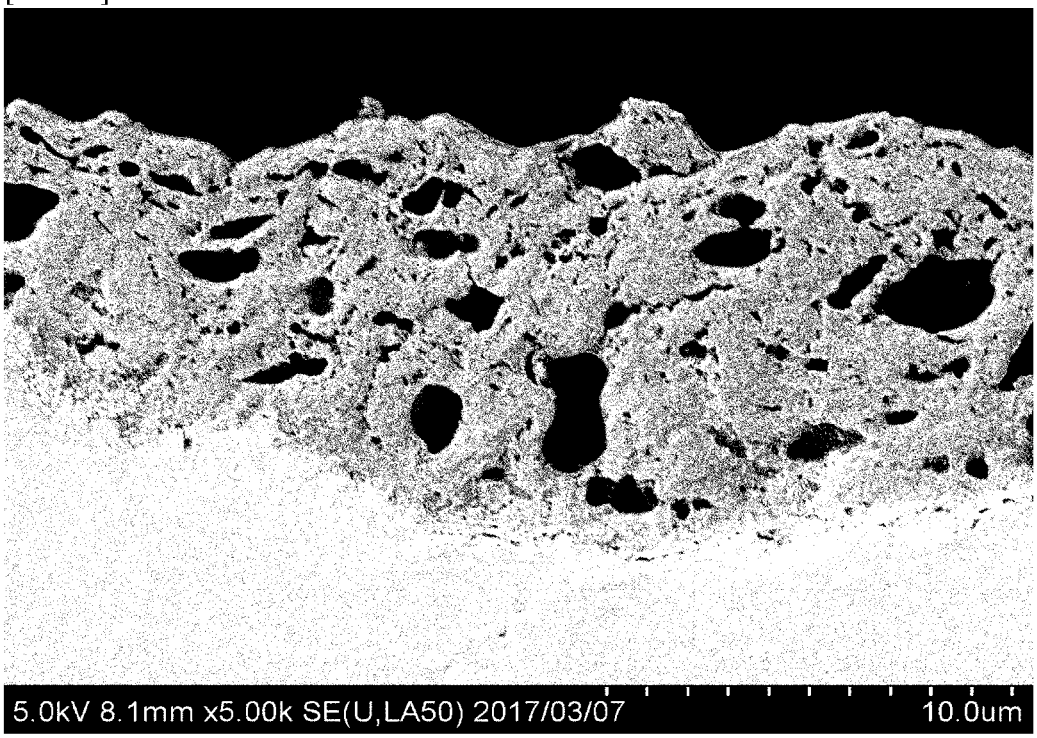
[FIG.12]
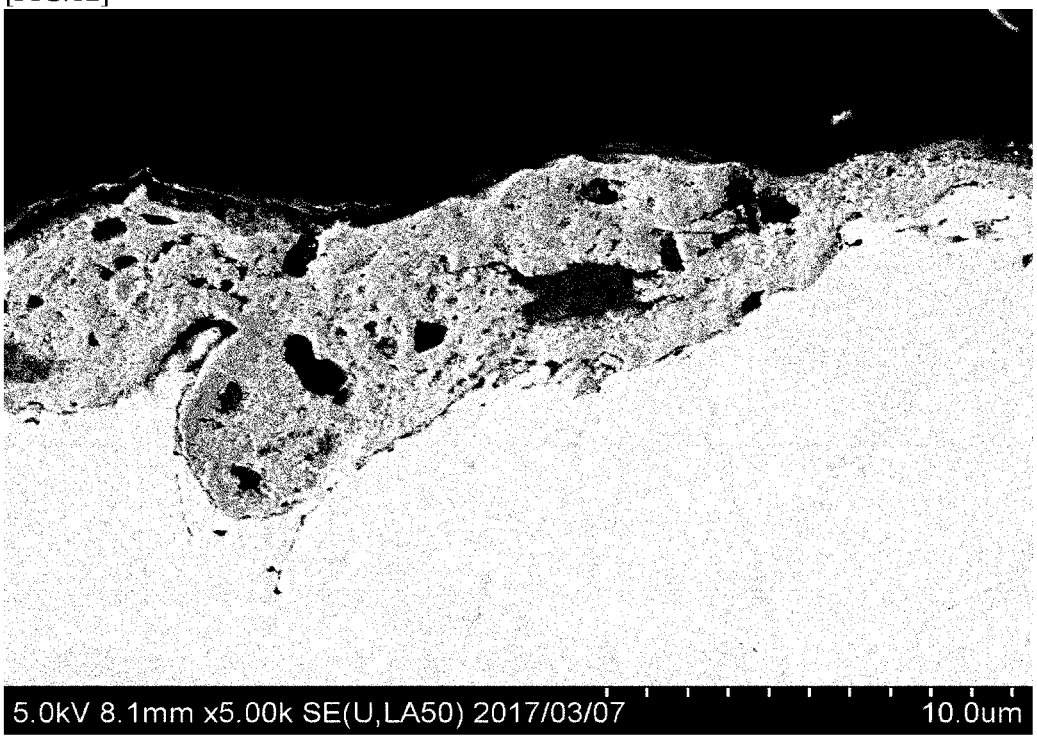

[FIG.13]
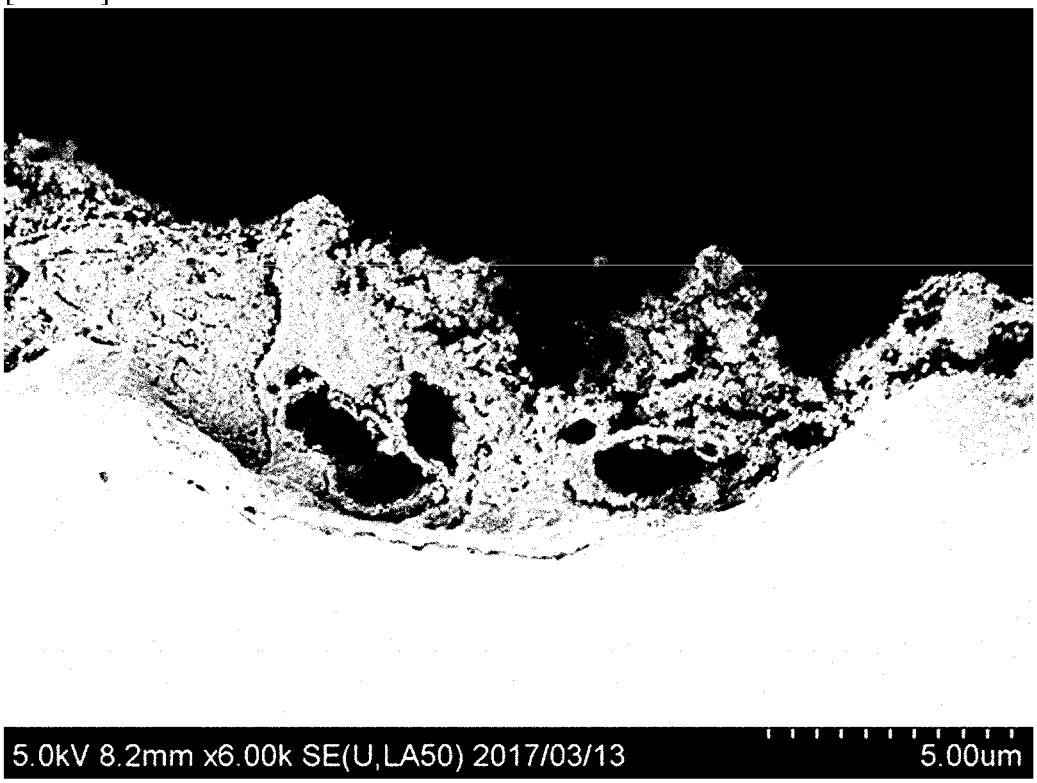
[FIG.14]
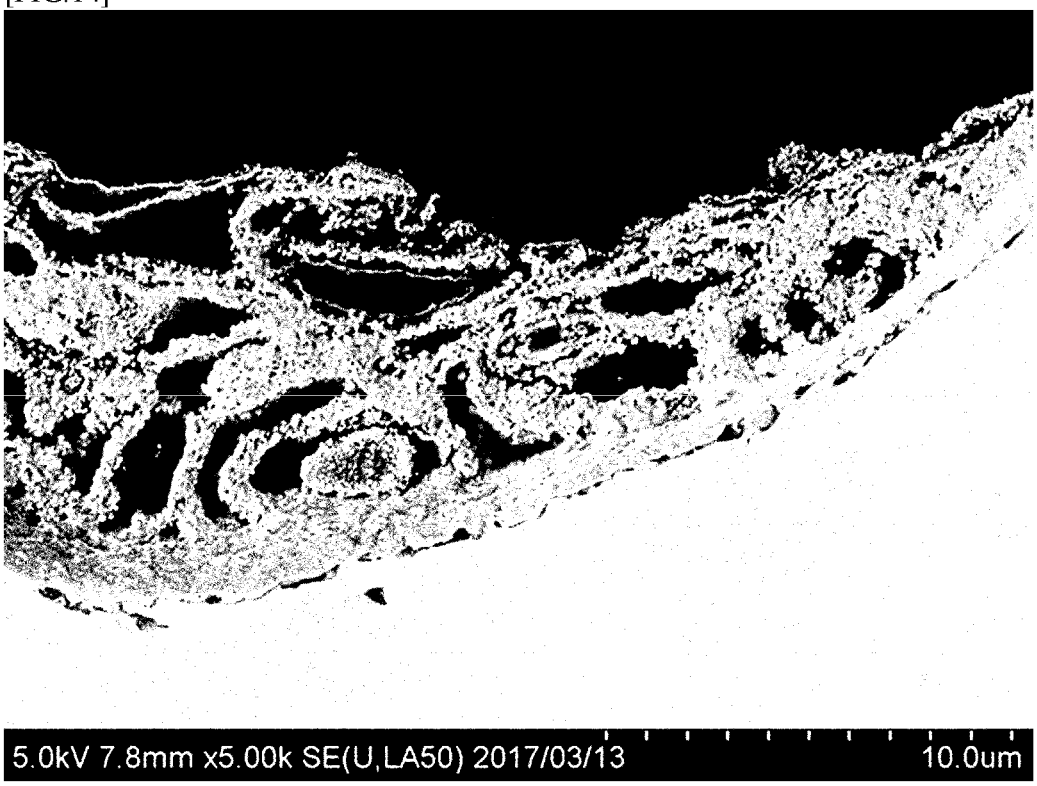

[FIG.15]
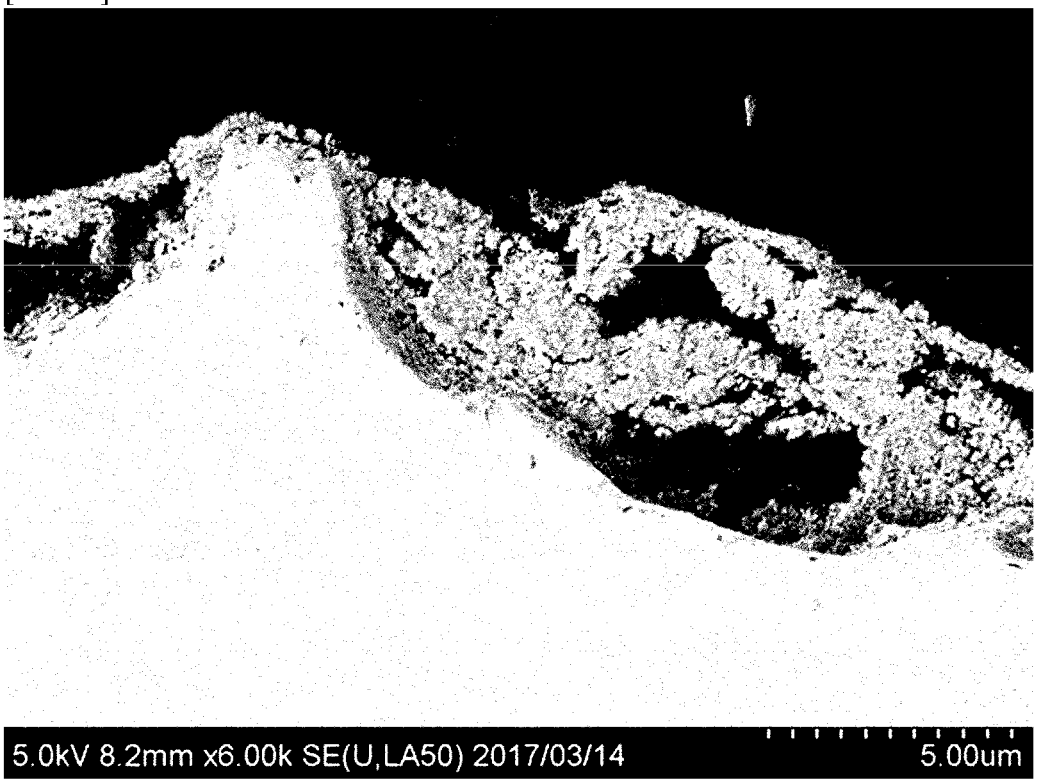
[FIG.16]
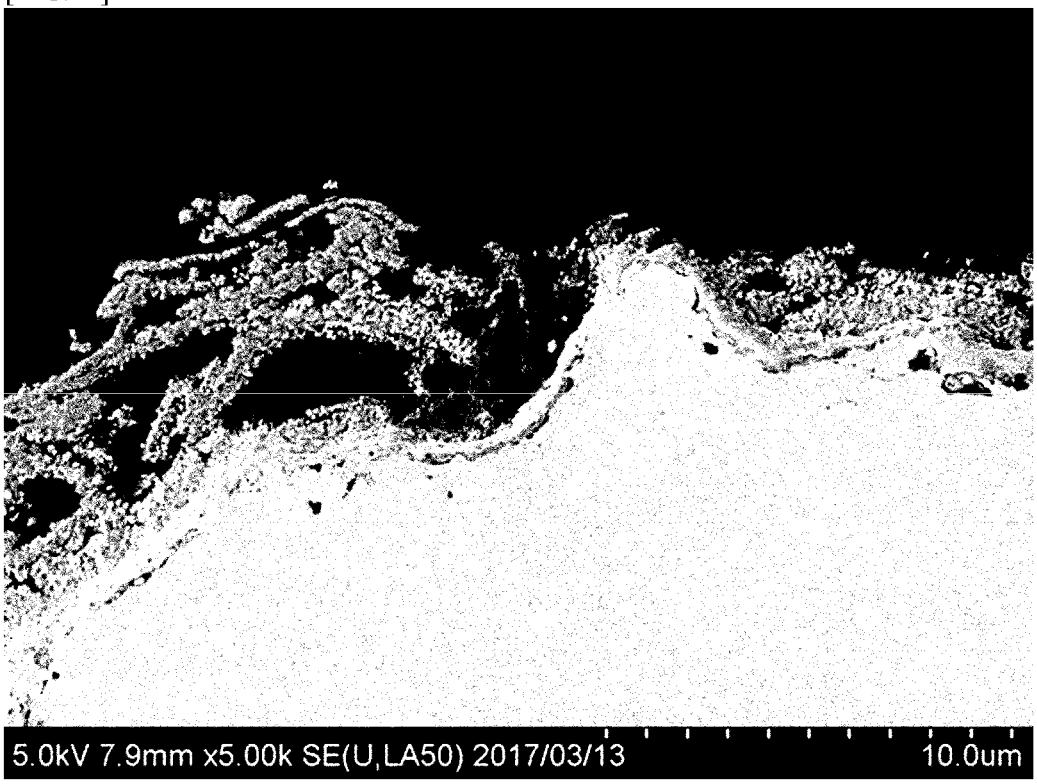

[FIG.17]
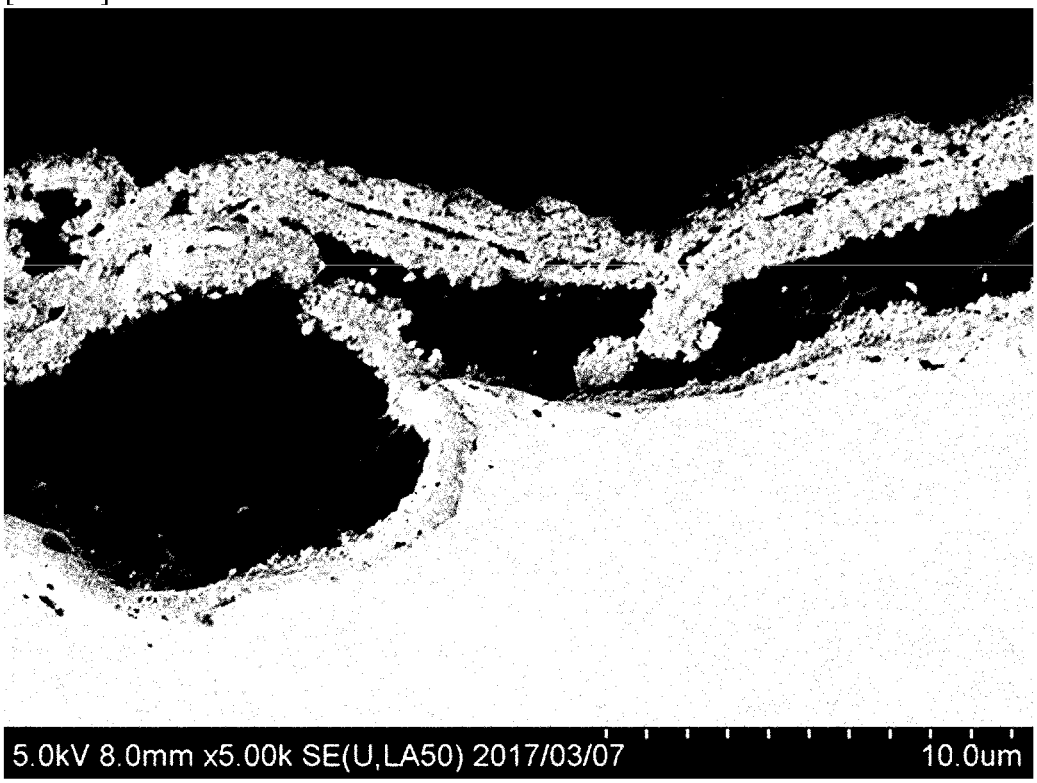
[FIG.18]
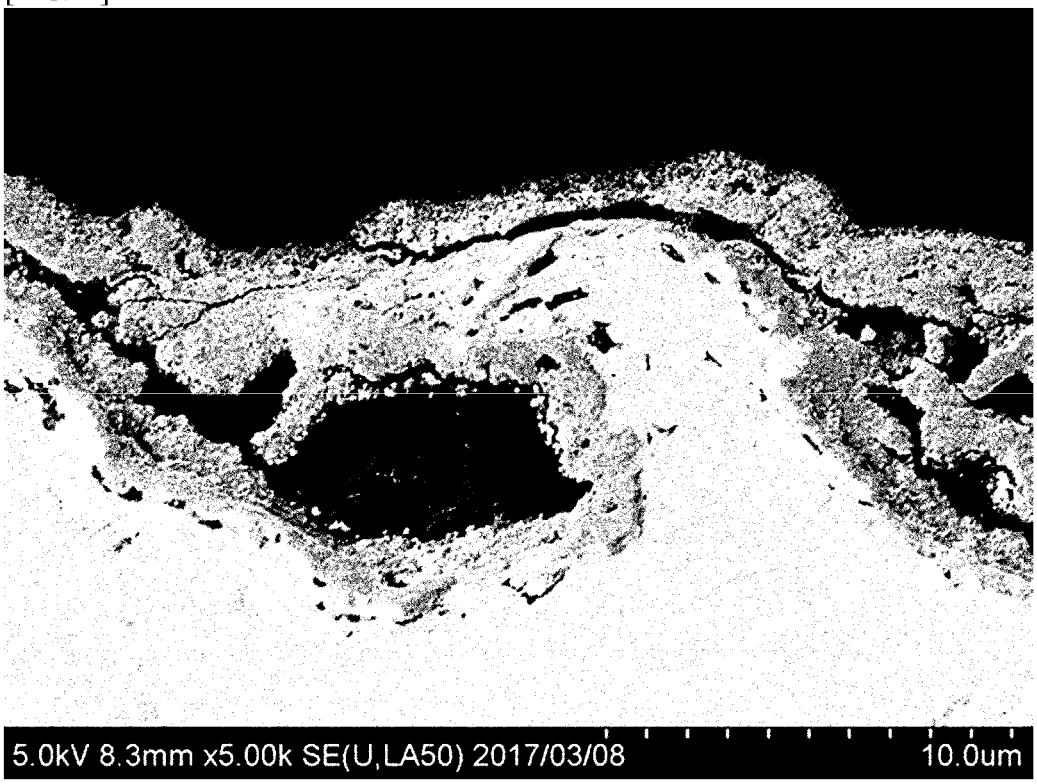

METHOD FOR PRODUCING ANODE FOR ALKALINE WATER ELECTROLYSIS, AND ANODE FOR ALKALINE WATER ELECTROLYSIS

TECHNICAL FIELD

The present invention relates to an anode used in alkaline water electrolysis, and a method for producing the anode.

BACKGROUND ART

Hydrogen is a next-generation energy source that is suitable for storage and transport, and has little environmental impact, and therefore hydrogen energy systems that use hydrogen as an energy carrier are attracting much interest. Currently, hydrogen is mainly produced by steam reforming or the like of fossil fuels, but from the viewpoints of problems such as global warming and fossil fuel depletion, the importance of alkaline water electrolysis using renewable energy as a power source continues to increase.

Water electrolysis can be broadly classified into two types. One type is alkaline water electrolysis, which uses a high-concentration alkaline aqueous solution as the electrolyte. The other type is solid polymer water electrolysis, which uses a solid polymer electrolyte (SPE) as the electrolyte. When large-scale hydrogen production is performed by water electrolysis, it is said that alkaline water electrolysis using an inexpensive material such as an iron-based metal of nickel or the like is more suitable than solid polymer water electrolysis using a diamond electrode or the like. The electrode reactions at the two electrodes are as follows.

$$\text{Anode reaction: } 2OH^- \rightarrow H_2O + \tfrac{1}{2}O_2 + 2e^- \quad (1)$$

$$\text{Cathode reaction: } 2H_2O + 2e^- \rightarrow H_2 + 2OH^- \quad (2)$$

High-concentration alkaline aqueous solutions increase in conductivity as the temperature increases, but the corrosiveness also increases. Accordingly, the upper limit for the operating temperature is limited to about 80 to 90° C. The development of electrolyzer structural materials and various piping materials that are capable of withstanding higher temperatures and high-concentration alkaline aqueous solutions, and the development of low-resistance diaphragms and electrodes having increased surface area and provided with a catalyst have enabled electrolysis performance to be improved to about 1.7 to 1.9 V at a current density of 0.3 to 0.4 $Acm^{-2}$ (efficiency: 78 to 87%).

A nickel-based material that is stable in high-concentration alkaline aqueous solutions is typically used as the anode for alkaline water electrolysis, and it has been reported that a Ni-based electrode has a lifespan of several decades or longer in alkaline water electrolysis that uses a stable power source (Non-Patent Documents 1 and 2). However, when renewable energy is used as the power source, degradation in the Ni anode performance caused by severe conditions such as abrupt start-stop operations and load fluctuations tends to be problematic (Non-Patent Document 3). The reason for this degradation is that it is known thermodynamically that nickel exists as a stable divalent hydroxide in alkaline aqueous solutions and that the oxidation reaction of the nickel metal proceeds near the potential of the oxygen generation reaction, and it is surmised that the type of nickel oxide production reaction outlined below proceeds.

$$Ni + 2OH^- \rightarrow Ni(OH)_2 + 2e^- \quad (3)$$

As the potential increases, oxidation to trivalent and tetravalent states occurs. The reaction formulas are as follows.

$$Ni(OH)_2 + OH^- \rightarrow NiOOH + H_2O + e^- \quad (4)$$

$$NiOOH + OH^- \rightarrow NiO_2 + H_2O + e^- \quad (5)$$

The nickel oxide production reaction and the reduction reaction of that oxide proceed at the metal surface, and therefore detachment of the electrode catalyst formed on the metal is accelerated. If the power required to perform the electrolysis can no longer be supplied, then electrolysis is halted, and the nickel anode is maintained at an electrode potential that is lower than the oxygen generation potential (1.23 V vs RHE) and higher than the potential of the cathode for hydrogen generation that functions as the counter electrode (0.00 V vs RHE). Electromotive forces generated by these chemical species occur inside the cell. The anode potential is maintained at a low potential due to progression of the cell reactions, in other words, oxide reduction reactions are promoted in accordance with the formulas (3), (4) and (5). In the case of an electrolyzer containing a combination of a plurality of cells, these types of cell reactions tend to cause current to leak through the piping connecting the cells, and therefore current prevention techniques are a matter that should always be considered. One such technique is a countermeasure in which a very small current flow is continued during stoppages, but this technique requires special power source control, and also results in continuous generation of oxygen and hydrogen, and therefore system control is time-consuming. In order to intentionally avoid a reverse current state, the above types of cell reactions can be prevented by removing the liquid immediately after a stoppage, but in the case where operations are performed using a power source such as renewable energy that is prone to large output fluctuations, this cannot be considered a suitable procedure.

In nickel-based cells, these types of oxides and hydroxides are used as active materials, but in alkaline water electrolysis, the activity of these types of nickel materials is preferably suppressed.

Conventionally, at least one component selected from among platinum-group metals, platinum-group metal oxides, valve metal oxides, iron-group oxides and lanthanide-group metal oxides has typically been used as the catalyst layer of the anode for oxygen generation that is used in alkaline water electrolysis. Other known anode catalysts include nickel-based alloys such as Ni—Co and Ni—Fe, surface area-expanded nickel, ceramic materials such as spinel $Co_3O_4$ and $NiCo_2O_4$, conductive oxides such as perovskite $LaCoO_3$ and $LaNiO_3$, noble metal oxides, and oxides formed from a lanthanide-group metal and a noble metal (Non-Patent Document 4).

In terms of the anode for oxygen generation used in alkaline water electrolysis, nickel itself has a small oxygen overvoltage, and sulfur-containing nickel-plated electrodes in particular are also used as the anode for water electrolysis.

An anode having a lithium-containing nickel oxide layer already formed on the surface of a nickel substrate is a known anode for oxygen generation for use in alkaline water electrolysis using a high-concentration alkaline aqueous solution (Patent Documents 1 and 2). An anode having a similar lithium-containing nickel oxide layer formed on the electrode has also been disclosed not for use in alkaline water electrolysis, but as a nickel electrode used in a hydrogen-oxygen fuel cell that uses an alkaline aqueous solution as the electrolyte (Patent Document 3). Patent Documents 1 to 3 include no mention of the lithium content relative to the nickel or the production conditions, and also make no mention of the stability of the electrode under conditions where the electric power suffers severe output fluctuations.

Patent Document 4 discloses an anode provided with a catalyst layer composed of a lithium-containing nickel oxide in which the molar ratio between lithium and nickel (Li/Ni) is within a range from 0.005 to 0.15. By using this catalyst layer, the crystal structure can be maintained even upon long-term use, and excellent corrosion resistance can also be maintained. As a result, the anode can be used in alkaline water electrolysis that uses a power source such as renewable energy that is prone to large output fluctuations.

CITATION LIST

Patent Literature

Patent Document 1: GB 864457
Patent Document 2: U.S. Pat. No. 2,928,783
Patent Document 3: U.S. Pat. No. 2,716,670
Patent Document 4: JP 2015-086420

Non-Patent Documents

Non-Patent Document 1: P. W. T. Lu, S. Srinivasan, J. Electrochem. Soc., 125, 1416 (1978)

Non-Patent Document 2: C. T. Bowen, Int. J. Hydrogen Energy, 9, 59 (1984)

Non-Patent Document 3: Shigenori Mitsushima, Koichi Matsuzawa, Hydrogen Energy Systems, 36, 11 (2011)

Non-Patent Document 4: J. P. Singh, N. K. Singh, R. N. Singh, Int, J. Hydrogen Energy, 24, 433 (1999)

SUMMARY OF INVENTION

Technical Problem

The catalyst layer composed of a lithium-containing nickel oxide disclosed in Patent Document 4 is formed by applying a solution containing at least the element lithium to a conductive substrate (in which at least the surface is formed from nickel or a nickel-based alloy), and then performing a heat treatment 900 to 1,000° C. Examples of the lithium component raw material include lithium nitrate, lithium carbonate and lithium chloride. However, because the method described in Patent Document 4 uses a high-temperature heat treatment, a problem arises in that a thick oxide coating is formed on the surface of the catalyst layer, resulting in an increase in the surface resistance and a deterioration in the catalyst performance. Furthermore, a furnace capable of conducting the high-temperature heat treatment is required, and other problems also arise such as an increase in the energy required for the firing process, and an increase in production costs.

The present invention has the objects of providing an electrode for electrolysis that can be used in alkaline water electrolysis and exhibits superior resistance to output fluctuation, and a method that enables production of this type of anode for alkaline water electrolysis in a simple and low-cost manner.

Solution to Problem

The inventors of the present invention discovered that by using a precursor prepared by dissolving lithium nitrate and a nickel carboxylate in water, the heat treatment temperature conditions required when forming the catalyst layer by a thermal decomposition method could be reduced dramatically compared with the conditions disclosed in Patent Document 4.

In other words, one aspect of the present invention is a method for producing an anode for alkaline water electrolysis, the method including a step of dissolving lithium nitrate and a nickel carboxylate in water to prepare an aqueous solution containing lithium ions and nickel ions, a step of applying the aqueous solution to the surface of a conductive substrate having at least the surface composed of nickel or a nickel-based alloy, and a step of subjecting the conductive substrate to which the aqueous solution has been applied to a heat treatment at a temperature within a range from at least 450° C. to not more than 600° C., thereby forming a catalyst layer composed of a lithium-containing nickel oxide on the conductive substrate.

In the above aspect, the lithium-containing nickel oxide is preferably represented by a compositional formula $Li_xNi_{2-x}O_2$ (wherein $0.02 \leq x \leq 0.5$).

Further, another aspect of the present invention is an anode for alkaline water electrolysis that contains a conductive substrate in which at least the surface is composed of nickel or a nickel-based alloy, and a catalyst layer formed from a lithium-containing nickel oxide represented by a compositional formula $Li_xNi_{2-x}O_2$ (wherein $0.02 \leq x \leq 0.5$) that is formed on the conductive substrate, wherein the layer average density of the catalyst layer is at least 5.1 g/cm$^3$ but not more than 6.67 g/cm$^3$.

Advantageous Effects of Invention

According to the present invention, by using lithium nitrate and a nickel carboxylate as the raw materials for the precursor to the catalyst layer, a lithium-containing nickel oxide catalyst layer can be formed at a heat treatment temperature of at least 450° C. but not more than 600° C., a much lower temperature than has conventionally been required. Because the heat treatment temperature is considerably lower than conventional temperatures, production of the anode is simpler, and production costs can also be lowered, both of which are advantageous. Further, by using nickel acetate as the nickel component raw material, a denser catalyst layer can be formed with a higher density than that obtainable by conventional methods using nickel nitrate.

Moreover, because the heat treatment temperature is low, the anode produced using the method of the present invention has reduced surface oxidation resistance. Further, catalytic activity is not lost even after performing accelerated life testing. Accordingly, even when the anode is used in an alkaline water electrolytic apparatus that uses a power source such as renewable energy that is prone to large output fluctuations, superior catalytic activity can be maintained over long periods, and an anode of excellent durability can be obtained.

BRIEF DESCRIPTION OF DRAWINGS

FIG. 1 is a schematic diagram illustrating one embodiment of an anode for alkaline water electrolysis.

FIG. 2 illustrates the X-ray diffraction patterns of the catalyst layers in Example 1 and Comparative Example 1.

FIG. 3(*a*) illustrates SEM images of electrode cross-sections in Example 1.

FIG. 3(*b*) illustrates SEM images of electrode cross-sections in Comparative Example 1.

FIG. 4 is a graph illustrating the voltage change during an accelerated life test in Example 1 and Comparative Example 1.

FIG. 5 is a graph illustrating the change in current density during an accelerated life test in Example 1 and Comparative Example 1.

FIG. 6 is a graph illustrating the change in current density during an accelerated life test in Example 2 and Comparative Example 2.

FIG. 7 is a SEM image of an electrode cross-section in Example 3.

FIG. 8 is a SEM image of an electrode cross-section in Example 4.

FIG. 9 is a SEM image of an electrode cross-section in Example 5.

FIG. 10 is a SEM image of an electrode cross-section in Example 6.

FIG. 11 is a SEM image of an electrode cross-section in Example 7.

FIG. 12 is a SEM image of an electrode cross-section in Example 8.

FIG. 13 is a SEM image of an electrode cross-section in Comparative Example 3.

FIG. 14 is a SEM image of an electrode cross-section in Comparative Example 4.

FIG. 15 is a SEM image of an electrode cross-section in Comparative Example 5.

FIG. 16 is a SEM image of an electrode cross-section in Comparative Example 6.

FIG. 17 is a SEM image of an electrode cross-section in Comparative Example 7.

FIG. 18 is a SEM image of an electrode cross-section in Comparative Example 8.

DESCRIPTION OF EMBODIMENTS

Embodiments of the present invention are described below together with the drawings.

FIG. 1 is a schematic drawing illustrating one embodiment of the anode for alkaline water electrolysis of the present invention. The anode 1 includes an anode substrate 2, and a catalyst layer 3 formed on the surface of the anode substrate 2.

(Anode Substrate)

The anode substrate 2 is a conductive substrate in which at least the surface is composed of nickel or a nickel-based alloy. The anode substrate 2 may be produced entirely from nickel or a nickel-based alloy. Alternatively, the anode substrate 2 may be produced by using plating or the like to form a coating of nickel or a nickel alloy on the surface of a metal material such as iron, stainless steel, aluminum or titanium.

The thickness of the anode substrate 2 is from 0.05 to 5 mm. The anode substrate 2 preferably has a form that has openings to enable removal of oxygen bubbles that are generated. For example, an expanded mesh or a porous expanded mesh can be used. The open area ratio of the anode substrate 2 is preferably from 10 to 95%.

A chemical etching treatment is typically performed to remove contaminant particles such as metals or organic matter from the substrate surface. The amount of the substrate consumed by the etching treatment is preferably about 30 to 400 g/m$^2$. Further, in order to enhance the adhesion to the catalyst layer 3, the surface of the anode substrate 2 is preferably subjected to a surface roughening treatment. Examples of the method used for the surface roughening treatment include a blast treatment in which a powder is blasted onto the surface, an etching treatment that uses an acid that can dissolve the substrate, or a plasma spraying treatment.

(Catalyst Layer)

The catalyst layer 3 is formed from a lithium-containing nickel oxide. Specifically, the lithium-containing nickel oxide is preferably represented by a compositional formula $Li_xNi_{2-x}O_2$ (wherein $0.02 \leq x \leq 0.5$). If x is less than 0.02, then satisfactory conductivity cannot be achieved. In contrast, if x exceeds 0.5, then the physical strength and chemical stability tend to deteriorate. By using the above composition, sufficient conductivity for electrolysis can be achieved, and excellent physical strength and chemical stability can be ensured even when the anode is used for long periods.

The catalyst layer 3 is formed by a thermal decomposition method.

First, a precursor to the catalyst layer is produced. The precursor is an aqueous solution containing lithium ions and nickel ions. The lithium component raw material is lithium nitrate ($LiNO_3$), and the nickel component raw material is a nickel carboxylate. Examples of the nickel carboxylate include nickel formate ($Ni(HCOO)_2$) and nickel acetate ($Ni(CH_3COO)_2$). Of these, the use of nickel acetate ($Ni(CH_3COO)_2$) is preferred. The lithium nitrate and nickel carboxylate are dissolved in water so that the molar ratio between lithium and nickel in the aqueous solution is within a range from Li:Ni=0.02:1.98 to 0.5:1.5. If consideration is given to the degree of solubility and the stability upon storage, then the concentration of the nickel carboxylate is preferably at least 0.1 mol/L but not more than 1 mol/L, and is more preferably from 0.1 to 0.6 mol/L.

The aqueous solution containing the lithium ions and nickel ions is applied to the surface of the anode substrate 2. Conventional methods may be used for the application method, including application by brush, roller, spin-coating or electrostatic spraying. Following application, the anode substrate 2 is dried. The drying temperature is preferably set so as to avoid sudden evaporation of the solvent (for example, about 60 to 80° C.).

After drying, the anode substrate 2 is subjected to a heat treatment. The heat treatment temperature is typically at least 450° C. but not more than 600° C., and is preferably at least 450° C. but not more than 550° C. The decomposition temperature of lithium nitrate is about 430° C., and the decomposition temperature of nickel acetate is about 373° C. By ensuring that the heat treatment temperature is at least 450° C., reliable decomposition of the components can be achieved. On the other hand, if the heat treatment temperature exceeds 600° C., then oxidation of the substrate may proceed excessively, leading to an increase in the electrode resistance and an increase in voltage loss. The heat treatment time may be set appropriately with due consideration of the reaction rate, the productivity, and the oxidation resistance of the catalyst layer surface.

By performing application of the aqueous solution a plurality of times, the catalyst layer 3 can be formed with the desired thickness. In this case, application of the aqueous solution and then drying may be repeated for each of the layers, with the entire structure being subjected to heat treatment at the temperature described above following formation of the uppermost layer. Alternatively, application of the aqueous solution and heat treatment at the above temperature (pretreatment) may be repeated for each of the layers, with the entire structure then being subjected to heat treatment at the temperature described above following completion of the heat treatment of the uppermost layer. The pretreatment and the heat treatment of the entire structure may be performed at the same temperature, or at different temperatures. Further, the pretreatment time is preferably shorter than the heat treatment time for the entire structure.

By performing the heat treatment described above, the catalyst layer 3 composed of a lithium-containing nickel oxide is formed. Because the heat treatment is performed at a comparatively low temperature, reaction between the nickel of the anode substrate 2 and the catalyst layer components is suppressed. In other words, the composition of the catalyst layer 3 is substantially the same as the molar ratio between lithium and nickel in the aqueous solution used as the precursor.

The anode for alkaline water electrolysis of the present invention, which can be produced using the production method described above, contains a dense catalyst layer having a high density. In other words, the anode for alkaline water electrolysis of the present invention contains the conductive substrate described above, and the catalyst layer formed from a lithium-containing nickel oxide represented by a compositional formula $Li_xNi_{2-x}O_2$ (wherein $0.02 \leq x \leq 0.5$) that is formed on this conductive substrate. The layer average density of the catalyst layer is at least 5.1 g/cm$^3$ but not more than 6.67 g/cm$^3$, is preferably at least 5.1 g/cm$^3$ but not more than 6.0 g/cm$^3$, and is more preferably at least 5.5 g/cm$^3$ but not more than 6.0 g/cm$^3$. Furthermore, the catalyst layer is very dense, with only a small proportion of pores formed within the interior of the layer. Specifically, the porosity of the catalyst layer (the value that represents the ratio of the surface area of pores (voids) relative to the entire catalyst layer) is preferably not more than 0.29, and more preferably 0.18 or less. The porosity of the catalyst layer can be calculated by image analysis of a cross-sectional photograph (SEM image) of the catalyst layer using the image processing software supplied with a commercially available CCD digital microscope used for image analysis (for example, an MSX-500Di manufactured by Moritex Corporation).

The layer average density (the apparent density D) of the catalyst layer formed on the conductive substrate can be measured and calculated using the procedure described below. First, a cross-sectional photograph (SEM image) of the catalyst layer is subjected to image analysis, and the porosity of the catalyst layer is calculated. The true density of the lithium-containing nickel oxide (LiNiO) is 6.67 g/cm$^3$. Accordingly, the layer average density (apparent density D) can be calculated from formula (1) below.

$$\text{Layer average density (g/cm}^3\text{)} = 6.67 \times (1 - \text{porosity}) \quad (1)$$

In a catalyst layer formed by the thermal decomposition method using nickel nitrate as the nickel component raw material, comparatively large numbers of pores tend to be formed, and forming a dense catalyst layer of high density is problematic. In contrast, when nickel acetate (a nickel carboxylate) is used as the nickel component raw material, the formed catalyst layer is denser with a higher density, even when firing is performed at low temperature.

Structural materials besides the anode in an alkaline water electrolytic cell are described below.

For the cathode, it is necessary to select a substrate material that can withstand alkaline water electrolysis and a catalyst with a small cathode overpotential. Examples of materials that can be used as the cathode substrate include simple nickel, or a nickel substrate that has been coated with an active cathode. In a similar manner to the anode, an expanded mesh or a porous expanded mesh can be used as the substrate.

Porous nickel electrodes and Ni—Mo systems having a large surface area have been widely studied as cathode materials. In addition, Raney nickel systems such as Ni—Al, Ni—Zn and Ni—Co—Zn, sulfide systems such as Ni—S, and hydrogen storage alloy systems such as $Ti_2Ni$ are also being investigated. Properties such as a low hydrogen overvoltage, superior short-circuit stability and high poisoning resistance are important, and examples of other preferred catalysts include metals such as platinum, vanadium, ruthenium and iridium, and oxides of those metals.

Examples of materials that have been proposed for the electrolytic diaphragm include asbestos, nonwoven fabrics, ion exchange membranes, porous polymer membranes, and composite membranes of an inorganic material and an organic polymer. For example, an ion-permeable diaphragm formed by incorporating an organic fiber fabric in a mixture of a hydrophilic inorganic material such as a calcium phosphate compound or calcium fluoride and an organic binder material selected from among polysulfone, polypropylene and polyvinylidene fluoride may be used. Further, an ion-permeable diaphragm containing a stretched organic fiber fabric in a film-forming mixture composed of a particulate inorganic hydrophilic material selected from among oxides and hydroxides of antimony and zirconium, and an organic binder selected from among fluorocarbon polymers, polysulfone, polypropylene, polyvinyl chloride and polyvinyl butyral may also be used.

In the alkaline water electrolysis in the present invention, a high-concentration alkaline water is used as the electrolyte. The electrolyte is preferably a caustic alkali such as caustic potash or caustic soda, and the concentration of the electrolyte is preferably from 1.5 to 40% by mass. In terms of suppressing power consumption, a concentration of 15 to 40% by mass, which represents the region in which the electrical conductivity is large, is particularly preferred. However, if consideration is also given to the costs associated with the electrolysis, and the corrosiveness, viscosity and usability of the electrolyte, then a concentration of 20 to 30% by mass is even more desirable.

EXAMPLES

Examples of the present invention are described below, but the present invention is not limited to these examples.

Example 1

Lithium nitrate (manufactured by Wako Pure Chemical Industries, Ltd., purity: 99%) and nickel acetate tetrahydrate ($Ni(CH_3COO)_2.4H_2O$, manufactured by Junsei Chemical Co., Ltd., purity: 98.0%) were added to pure water and dissolved to form a precursor. The molar ratio between lithium and nickel in the aqueous solution was set to Li:Ni=0.1:1.9. The concentration of nickel acetate in the aqueous solution was set to 0.3 mol/L.

For the anode substrate, a nickel plate (surface area: 1.0 cm$^2$) that had been subjected to a chemical etching treatment by immersion for 6 minutes in a solution of 17.5% by mass hydrochloric acid at a temperature close to the boiling point was used. The aqueous solution described above was applied to the anode substrate using a brush, and was then dried under conditions of 80° C. for 15 minutes. Subsequently, a heat treatment (pretreatment) was performed in the open atmosphere under conditions of 550° C. for 15 minutes.

After repeating the process from application to pretreatment 40 to 50 times, a heat treatment was performed in the open atmosphere under conditions of 550° C. for one hour, thus obtaining a catalyst layer. The thickness of the catalyst layer in Example 1 was 15 μm.

Comparative Example 1

Lithium nitrate (the same as Example 1) and nickel nitrate hexahydrate ($Ni(NO_3)_2.6H_2O$, manufactured by Junsei Chemical Co., Ltd., purity: 98.0%) were added to pure water and dissolved to form a precursor. The molar ratio between lithium and nickel in the aqueous solution was set to the same ratio as Example 1. The concentration of nickel nitrate in the aqueous solution was set to 1.0 mol/L.

Using the same anode substrate as Example 1, application, drying and heat treatment were performed in the same manner as Example 1 to obtain a catalyst layer. The thickness of the catalyst layer in Comparative Example 1 was 23 μm.

X-ray diffraction analyses were performed for the catalyst layers of Example 1 and Comparative Example 1. The amount of Li doping in each catalyst layer was calculated from the X-ray diffraction pattern. The results were 0.12 for Example 1 and 0.11 for Comparative Example 1. These values were equivalent to the Li content in the respective aqueous solutions.

FIG. 2 shows the X-ray diffraction patterns for Example 1 and Comparative Example 1. FIG. 3 shows SEM images of electrode cross-sections for (a) Example 1 and (b) Comparative Example 1.

As illustrated in FIG. 2, peaks appeared at the same positions in Example 1 and Comparative Example 1. This indicates that Example 1 and Comparative Example 1 have similar crystal structures. However, as illustrated in FIG. 3(*a*), the oxide layer (catalyst layer) of Example 1 was thinner than the catalyst layer of Comparative Example 1.

As illustrated in FIG. 3, it is evident that the catalyst layer of (a) Example 1 was a dense oxide, whereas the catalyst layer of (b) Comparative Example 1 was a porous oxide. As a result, it is thought that in Comparative Example 1, electrode wear during durability testing is likely to cause penetration of the electrolyte into the substrate, leading to corrosion of the substrate.

Accelerated life tests were performed on Example 1, Comparative Example 1 and a nickel plate (with no catalyst layer).

First, prior to the accelerated life test, each sample was subjected to an SSV (slow scan voltammetry) under the following conditions. Based on the SSV results, the voltage and current density during oxygen generation were calculated for each sample.

Electrolyte: 25% by mass aqueous solution of KOH, temperature: 30° C.±1° C.

Potential range: 0.5 V to 1.8 V

Scan rate: 5 mV/sec

Counter electrode: Ni coil

Reference electrode: reversible hydrogen electrode (RHE)

Measurement atmosphere: nitrogen atmosphere

Number of cycles: 5

Subsequently, cyclic voltammetry (CV) was performed in the same electrolyte under the following conditions. An SSV was performed under the above conditions after completion of each cycle.

Potential range: 0.5 V to 1.8 V

Scan rate: 1 V/sec

Number of cycles: 0, 1,000, 3,000, 5,000, 10,000, 15,000, 20,000 cycles

FIG. 4 is a graph illustrating the voltage change for each sample as a result of the accelerated life test. FIG. 4 illustrates the voltage at 10 mA. FIG. 5 is a graph illustrating the change in current density for each sample as a result of the accelerated life test. FIG. 5 illustrates the current density at a voltage of 1.6 V.

In the case of the nickel plate, compared with Example 1 and Comparative Example 1, the voltage prior to the accelerated life test tended to be lower, and the current density tended to be higher. However, as the number of cycles increased, a tendency for the voltage to increase and the current density to decrease was observed. This indicates that once a certain number of cycles is exceeded, the electrode performance begins to deteriorate.

In Example 1, once the accelerated life test started, the voltage decreased and the current density increased. Once 1,000 cycles were exceeded, the voltage and the current density in Example 1 became constant.

Comparative Example 1 exhibited substantially the same voltage and current density as Example 1 prior to the accelerated life test, but as the number of cycles increased, a tendency for the voltage to gradually increase and the current density to gradually decrease was observed.

These results indicated that in the case of Example 1, the accelerated life test caused an improvement in the electrochemical properties, and that performance was able to be maintained over a long period.

Example 2

Using a similar process to Example 1, a catalyst layer was formed on a nickel plate (surface area: 1.0 $cm^2$), thus producing an anode of Example 2.

Comparative Example 2

An anode of Comparative Example 2 was produced using the method disclosed in Patent Document 4. In other words, the same nickel plate as Example 1 was immersed for one hour in a 5% by mass aqueous solution of lithium hydroxide (lithium component raw material:lithium hydroxide monohydrate ($LiOH.H_2O$, manufactured by Wako Pure Chemical Industries, Ltd., purity: 98.0 to 102.0%). Subsequently, a heat treatment was performed in the open atmosphere under conditions of 1,000° C. for one hour. The results of X-ray diffraction analysis revealed that the composition of the catalyst layer of Comparative Example 2 was $Li_{0.14}Ni_{1.86}O_2$.

Example 2 and Comparative Example 2 were subjected to the same accelerated life testing (SSV and CV) as that described above. FIG. 6 is a graph illustrating the change in current density in Example 2 and Comparative Example 2 as a result of the accelerated life tests. FIG. 6 illustrates the current density at a voltage of 1.7 V.

In Example 2, a similar trend to FIG. 5 was observed even though the voltage was different, and the catalyst was activated as the number of cycles increased. In contrast, in Comparative Example 2, the catalyst performance deteriorated as the number of cycles increased.

Furthermore, the layer average densities of the catalyst layers of Examples 1 and 2, calculated by performing image analyses of SEM images of the electrode cross-sections, were from 5.5 to 5.9 $g/cm^3$. In contrast, the layer average densities of the catalyst layers of Comparative Examples 1 and 2, calculated by performing image analyses of SEM images of the electrode cross-sections, were less than 5.1 g/cm$^3$.

Example 3

Lithium nitrate (manufactured by Wako Pure Chemical Industries, Ltd., purity: 99%) and nickel acetate tetrahydrate ($Ni(CH_3COO)_2.4H_2O$, manufactured by Junsei Chemical Co., Ltd., purity: 98.0%) were added to pure water and dissolved to form a precursor. The molar ratio between lithium and nickel in the aqueous solution was set to Li:Ni=0.1:1.9. The concentration of nickel acetate in the aqueous solution was set to 0.56 mol/L.

For the anode substrate, a nickel expanded mesh (10 cm×10 cm, LW×3.7SW×0.9ST×0.8T) that had been subjected to a chemical etching treatment by immersion for 6 minutes in a solution of 17.5% by mass hydrochloric acid at a temperature close to the boiling point was used. The aqueous solution described above was applied to the anode substrate using a brush, and was then dried under conditions of 60° C. for 10 minutes. Subsequently, a heat treatment was performed in the open atmosphere under conditions of 500° C. for 15 minutes. The process from application to heat treatment was repeated 20 times to obtain a catalyst layer. The thickness of the catalyst layer in Example 3 was 3.8 μm. An SEM image of an electrode cross-section of Example 3 is shown in FIG. 7.

Examples 4 to 8, Comparative Examples 3 to 8

With the exception of using the conditions shown in Table 1, catalyst layers were formed in the same manner as Example 3 described above, thus obtaining electrodes of Examples 4 to 8 and Comparative Examples 3 to 8. The properties of each of the obtained electrode catalyst layers (oxides) are shown in Table 2. Representative examples of the layer average density values for the catalyst layers of the comparative examples are shown only for Comparative Examples 3 and 4. Further, SEM images of a cross-section of each of the obtained electrodes are shown in FIGS. 8 to 18. The layer average densities of the catalyst layers were calculated using the image processing software supplied with an MSX-500Di device manufactured by Moritex Corporation, by binarizing the SEM images of FIGS. 7 to 14, and then determining the value of [porosity=pore surface area/total surface area] from the pixel count.

TABLE 1

| | Aqueous solution | | | | Heat treatment | | |
|---|---|---|---|---|---|---|---|
| | Ni component raw material | Li component raw material | Li and Ni molar ratio (Li:Ni) | Concentration of nickel acetate (nickel nitrate) (mol/L) | Temperature (° C.) | Time (minutes) | Number of repetitions of application-heat treatment |
| Example 3 | Nickel acetate tetrahydrate | Lithium nitrate | 0.1:1.9 | 0.56 | 500 | 15 | 20 |
| Example 4 | | | | | 600 | | |
| Example 5 | | | 0.3:1.7 | | 500 | | |
| Example 6 | | | | | 600 | | |
| Example 7 | | | 0.5:1.5 | | 500 | | |
| Example 8 | | | | | 600 | | |
| Comparative Example 3 | Nickel nitrate hexahydrate | | 0.1:1.9 | 2 | 500 | | 8 |
| Comparative Example 4 | | | | | 600 | | |
| Comparative Example 5 | | | 0.3:1.7 | | 500 | | |
| Comparative Example 6 | | | | | 600 | | |
| Comparative Example 7 | | | 0.5:1.5 | | 500 | | |
| Comparative Example 8 | | | | | 600 | | |

TABLE 2

| | Catalyst layer (oxide) | | | |
|---|---|---|---|---|
| | Composition | Thickness (μm) | Layer average density (g/cm$^3$) | SEM image |
| Example 3 | $Li_{0.1}Ni_{1.9}O_2$ | 3.8 | 5.6 | FIG. 7 |
| Example 4 | | 6.5 | 5.5 | FIG. 8 |
| Example 5 | $Li_{0.3}Ni_{1.7}O_2$ | 6.7 | 5.8 | FIG. 9 |
| Example 6 | | 6.5 | 5.8 | FIG. 10 |
| Example 7 | $Li_{0.5}Ni_{1.5}O_2$ | 8.3 | 5.9 | FIG. 11 |
| Example 8 | | 5.1 | 5.8 | FIG. 12 |
| Comparative Example 3 | $Li_{0.1}Ni_{1.9}O_2$ | 5.1 | 5.0 | FIG. 13 |
| Comparative Example 4 | | 7.7 | 3.6 | FIG. 14 |
| Comparative Example 5 | $Li_{0.3}Ni_{1.7}O_2$ | 5.0 | — | FIG. 15 |
| Comparative Example 6 | | 5.1 | — | FIG. 16 |
| Comparative Example 7 | $Li_{0.5}Ni_{1.5}O_2$ | 5.1 | — | FIG. 17 |
| Comparative Example 8 | | 6.1 | — | FIG. 18 |

As shown in FIGS. 13 to 18, it is evident that in Comparative Examples 3 to 8, which used nickel nitrate as the nickel component raw material, sparse catalyst layers containing many pores were formed. In contrast, as shown in FIGS. 7 to 12, it is evident that in Examples 3 to 8, which used nickel acetate as the nickel component raw material, dense catalyst layers having few pores and high density were formed, even when the composition (the molar ratio between Li and Ni) and the temperature of the heat treatment were altered.

The above results indicated that by preparing an aqueous solution of a catalyst layer precursor using lithium nitrate and nickel acetate, the temperature of the heat treatment used for forming the catalyst layer composed of a lithium-containing nickel oxide could be reduced. Further, it is also evident that the anode produced using the method of the present invention exhibits improved catalyst performance in the initial stages of accelerated life testing, and is able to maintain superior catalyst performance over long periods. Accordingly, even when used in an alkaline water electrolytic apparatus that uses a power source such as renewable energy that is prone to large output fluctuations, superior catalyst performance can be maintained over a long period, and the anode can be said to exhibit excellent durability.

REFERENCE SIGNS LIST

1: Anode
2: Anode substrate
3: Catalyst layer

The invention claimed is:

1. A method for producing an anode for alkaline water electrolysis, the method comprising:

dissolving lithium nitrate and a nickel carboxylate in water so as to obtain an aqueous solution comprising lithium ions and nickel ions, applying the aqueous solution to a surface of a conductive substrate, wherein at least the surface of the substrate comprises nickel or a nickel-based alloy, and subjecting the conductive substrate to which the aqueous solution has been applied to a heat treatment at a temperature within a range from 450° C. to 600° C., thereby forming a catalyst layer comprising a lithium-containing nickel oxide on the conductive substrate, wherein the lithium-containing nickel oxide is represented by a compositional formula $Li_xNi_{2-x}O_2$, wherein x is $0.02 \leq x \leq 0.5$.

2. The method for producing an anode for alkaline water electrolysis according to claim 1, wherein a porosity of the catalyst layer is in a range of 0.29 or less.

3. The method for producing an anode for alkaline water electrolysis according to claim 1, wherein the nickel carboxylate is nickel formate or nickel acetate or a combination thereof.

4. The method for producing an anode for alkaline water electrolysis according to claim 1, wherein the catalyst layer has a layer average density in a range from 5.1 g/cm$^3$ to 6.67 g/cm$^3$.

5. The method for producing an anode for alkaline water electrolysis according to claim 1, wherein x in the compositional formula $Li_xNi_{2-x}O_2$ representing the lithium-containing nickel oxide is $0.3 \leq x \leq 0.5$.

6. The anode for alkaline water electrolysis produced by the method according to claim 1, wherein the catalyst layer has a layer average density in a range from 5.1 g/cm$^3$ to 6.67 g/cm$^3$.

7. An anode for alkaline water electrolysis, comprising:

a conductive substrate having at least a surface comprising nickel or a nickel-based alloy; and a catalyst layer comprising a lithium-containing nickel oxide represented by a compositional formula $Li_xNi_{2-x}O_2$, wherein x is $0.3 \leq x \leq 0.5$, which is formed on the conductive substrate, wherein a layer average density of the catalyst layer is in a range from 5.1 g/cm$^3$ to 6.67 g/cm$^3$.

8. The anode for alkaline water electrolysis according to claim 7, wherein a porosity of the catalyst layer is in a range of 0.29 or less.

9. The anode for alkaline water electrolysis according to claim 7, wherein the lithium-containing nickel oxide is derived from lithium nitrate and a nickel carboxylate, and the nickel carboxylate is nickel formate or nickel acetate or a combination thereof.

10. The anode for alkaline water electrolysis according to claim 7, wherein the catalyst layer has the layer average density in a range from 5.8 g/cm$^3$ to 6.67 g/cm$^3$.

* * * * *